United States Patent [19]

Meyer

[11] Patent Number: 5,026,313

[45] Date of Patent: Jun. 25, 1991

[54] MODEL AIRPLANE

[76] Inventor: Brunhilde Meyer, Gerhart-Hauptmann-Weg 8, 5068 Odenthal-Gloebusch, Fed. Rep. of Germany

[21] Appl. No.: 374,914

[22] Filed: Jun. 29, 1989

Related U.S. Application Data

[63] Continuation-in-part of Ser. No. 142,719, Jan. 11, 1988, abandoned.

[51] Int. Cl.[5] ..... A63H 27/14; A63H 27/00

[52] U.S. Cl. ..... 446/64; 446/66

[58] Field of Search ..... 446/34, 61, 62, 63, 446/64, 65, 66, 67, 68

[56] References Cited

U.S. PATENT DOCUMENTS

| | | | |
|---|---|---|---|
| 2,275,094 | 3/1942 | Taylor | 446/66 |
| 2,373,957 | 4/1945 | Hornberger | 446/63 |
| 2,539,357 | 1/1951 | Wald | 446/34 X |
| 2,664,666 | 1/1954 | Walker | 446/61 |
| 3,063,191 | 11/1962 | Main | 446/61 |
| 3,246,425 | 4/1966 | Miller | 446/66 X |
| 3,264,777 | 8/1966 | McCreary, Jr. | 446/66 X |
| 3,902,271 | 9/1975 | Turoff et al. | 446/65 |
| 4,064,647 | 12/1977 | Lemelson | 446/65 |
| 4,388,777 | 6/1983 | Hermann et al. | 446/61 |
| 4,836,817 | 6/1989 | Corbin | 446/63 X |

FOREIGN PATENT DOCUMENTS

| | | | |
|---|---|---|---|
| 2374929 | 7/1978 | France | 446/64 |
| 483018 | 4/1938 | United Kingdom | 446/63 |
| 575750 | 4/1946 | United Kingdom | 446/64 |
| 2104788 | 3/1983 | United Kingdom | 446/34 |

*Primary Examiner*—Robert A. Hafer
*Assistant Examiner*—D. Neal Muir
*Attorney, Agent, or Firm*—Michael J. Striker

[57] ABSTRACT

A model airplane of the glider or sailplane type made of foamed plastics, comprising rigid stabilizing surfaces and wings and having the bottom side of the fuselage provided with a catapulting hook disposed in the vicinity of the center of gravity in a vertical plane extending through the longitudinal axis of the fuselage, and a sweptback wing profile with a large sweepback and decreasing in thickness and depth from the wing root at the fuselage to the tips of the wing, the connecting lines between the outermost points of the profile sections of the wings having an angle of wing setting $\alpha$ which increases, with regard to the longitudinal axis LA of the fuselage from wing roots to wing tips.

5 Claims, 3 Drawing Sheets

FIG.1
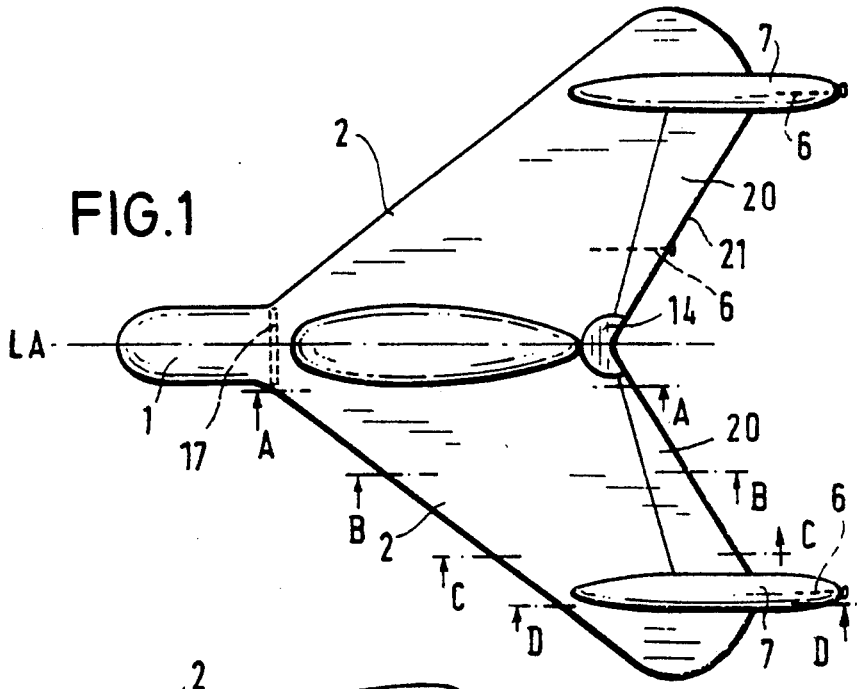
FIG.2a
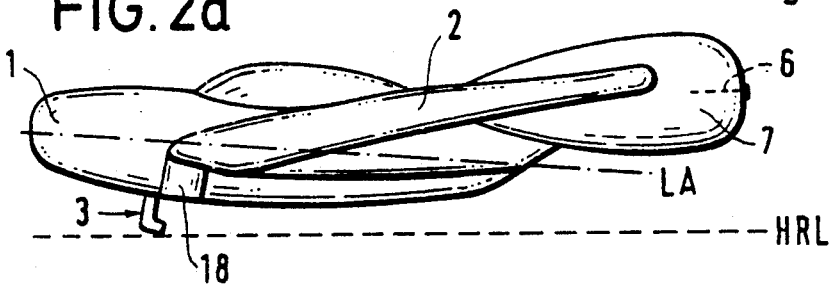
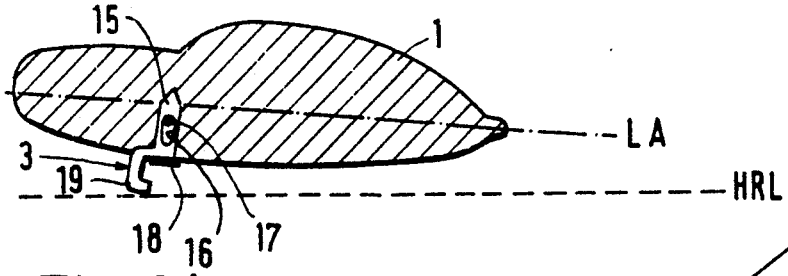
FIG.2b
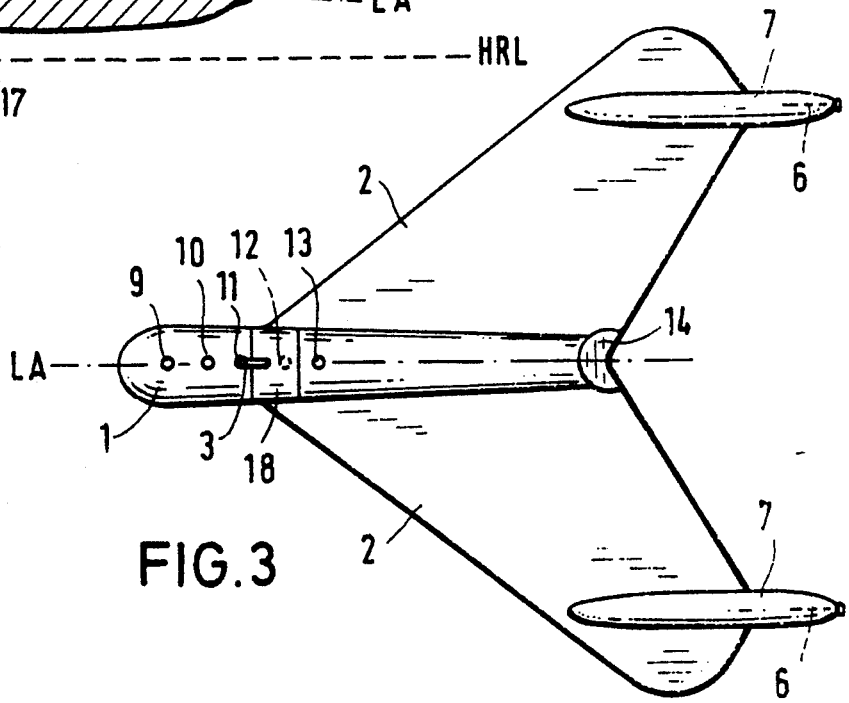
FIG.3

MODEL AIRPLANE

RELATED APPLICATIONS

This application is a continuation-in-part of application Ser. No. 142,719 filed Jan. 11, 1988 now abandoned.

BACKGROUND OF THE INVENTION

The invention relates to a model airplane of the glider or sailplane type made of foamed plastics, comprising rigid stabilizing surfaces and wings and having the bottom side of the fuselage provided with a hook disposed in the vicinity of the center of gravity in a vertical plane extending through the longitudinal axis of the fuselage, which hook is adapted for engaging an elastic band of the catapult.

Model planes are known to be more or less faithful reproductions of original or an altered scale—mostly of a scaled-down size—of very light materials (French Patent 2,374,929, German Utility Model 7,822,235, U.S. Pat. No. 4,512,690) or to be more or less imaginative aeroplane-like bodies (U.S. Pat. No. 3,619,937, U.S. Pat. No. 4,512,690) of optionally selectable materials.

In the case of air-worthy objects, the construction has to be stable in flight. The flight stability is achieved by the outer shape of the object. There also is a possibility of a limited control of the airplane by providing a construction stable in flight. Thus, one can also achieve certain aerobatic figures, in most cases, however, given a rather low technical expenditure, only during descent.

Climbing flights and aerobatic figures are mostly only possible at a rather high technical expenditure either as glider tugs or by providing the airplane with a remote-controlled engine. Such model airplanes are rather expensive and require a large free area of movement without any flight obstacles. Remote-controlled model airplanes can return to the launching site, but they may also get lost in adverse weather conditions, errors in operation or due to malfunctions, resulting in corresponding financial losses. Besides, motorized model airplanes generate disturbing noise and often must not be operated in residential areas or be operated only in zones open for such purposes.

Gliders for flinging or catapulting are known that are made by extrusion of very light and comparatively cheap materials, e.g. polyurethane (French Patent 2,374,929). Such model airplanes can be fit for flying without requiring much time-consuming assembling, but they cannot fly loopings safely. Due to an often unstable straight descent, they often have to be fetched from remote locations or get lost, e.g. in impassable terrains, high tree tops, in closed land areas or nearby bodies of water. In some cases, they also present a danger to the user, other players or persons not involved in the game, if the flinging or catapulting operation is maladroitly performed, or if the flight path is adversely influenced by winds.

SUMMARY OF THE INVENTION

It is an object of the invention to provide a model airplane of the above kind that can safely perform aerobatic figures like circles and loopings with high precision and reproducibility, and which is cheap in production.

The object of the invention is achieved by providing a model airplane of the glider or sailplane type, comprising rigid stabilizing surfaces and wings and having the bottom side of the fuselage provided with a catapulting hook disposed in the vicinity of the center of gravity in a vertical plane extending through the longitudinal axis of the fuselage, in which model airplane the sweepback profile with a large sweepback of the wings decreases in thickness and depth from the wing root at the fuselage to the wing tips, the connecting line A—A, B—B, C—C, D—D between the outermost points of the profile sections of the wings showing an angle of wing setting $\alpha$, the inclination of which, with regard to the longitudinal axis LA of the fuselage, increases towards the bottom side of the fuselage in the direction of flight.

This special three-dimensional profiling of the wings, namely an angle of wing setting and a profile section varying over the wing span, allows a safe performance of loopings around a horizontal axis and/or of circles around a vertical axis, in which the plane of the wings is almost vertical. Launching the model airplane can be performed with a catapulting hook, variably fixable at the bottom side of the fuselage in the vertical central longitudinal plane, in connection with a catapult, circles and loopings of different diameters d being possible. The particular aerodynamic properties of the airplane of the present invention guarantee an invariable return of the airplane to the plane's launching site.

The model airplane of the present invention is a glider or a sailplane which, as a boomerang-plane, is capable of performing aerobatic figures like circles or loopings of various and relatively small diameters. The high precision and the reproducibility of the flight performance excludes both, a loss of the airplane and a danger to people, given an adequate operation of the model airplane.

The model airplane of the present invention is made of foamed plastics and maintains a high dimensional stability even after a great number of flights. The model airplane remains undamaged even when colliding with posts, trees or buildings, and even after the accompanying crashes. As an unmotorized catapult glider, such a model airplane avoids environmental pollution, is as inexpensive as can be and allows studying of the laws of fluid dynamics and aerodynamics at very low operating costs.

It is an essential feature of the model airplane of the present invention that the airplane safely returns to the launching site, performing, if aptly handled, complex aerobatic figures like complex homings that is specific complicated flights to particular targets without requiring much space, if necessary even in closed rooms.

The present invention both as to its construction so to its mode of operation, together with additional objects and advantages thereof, will be best understood from the following description of the preferred embodiments with reference to the accompanying drawings.

BRIEF DESCRIPTION OF THE DRAWINGS

FIG. 1 is a top view of the top side of a model airplane of the present invention;

FIG. 2*a* is a side view of a model airplane shown in FIG. 1;

FIG. 2*b* is a vertical cross-sectional view through the central longitudinal plane of the model airplane with inserted and secured catapulting hook;

FIG. 3 is a top view of the bottom side of the model airplane;

DESCRIPTION OF THE PREFERRED EMBODIMENT

Figure 4A:
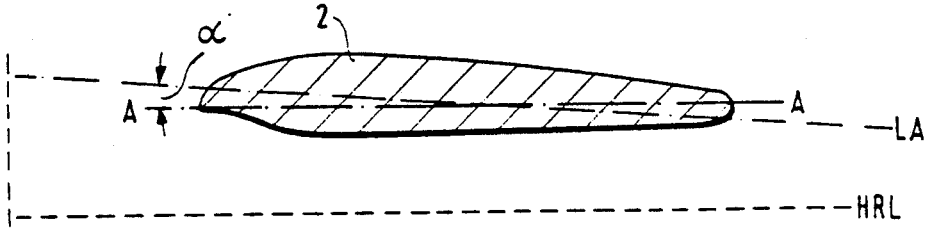
FIG. 4 is a vertical cross-sectional view of a wing in various sectional planes as indicated in FIG. 1.
Figure 4B:
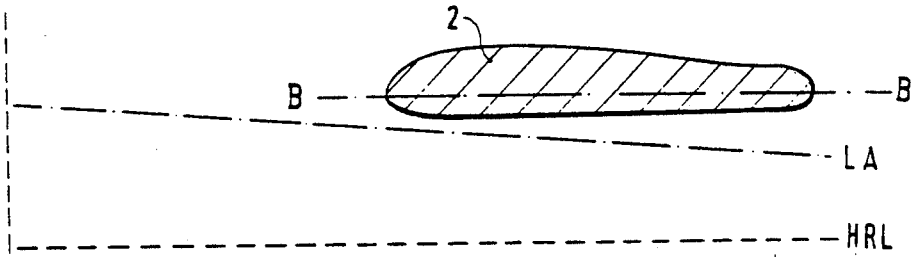
Figure 4C:
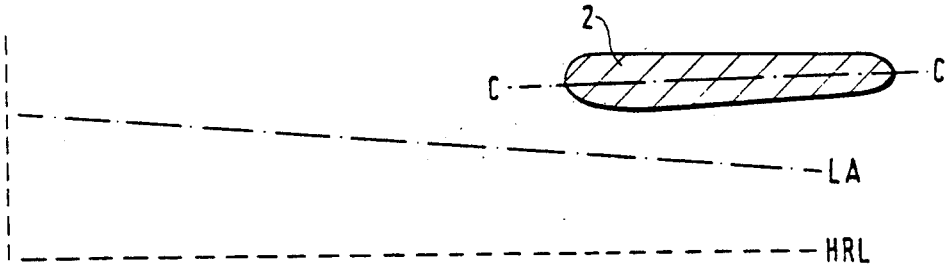
Figure 4D:
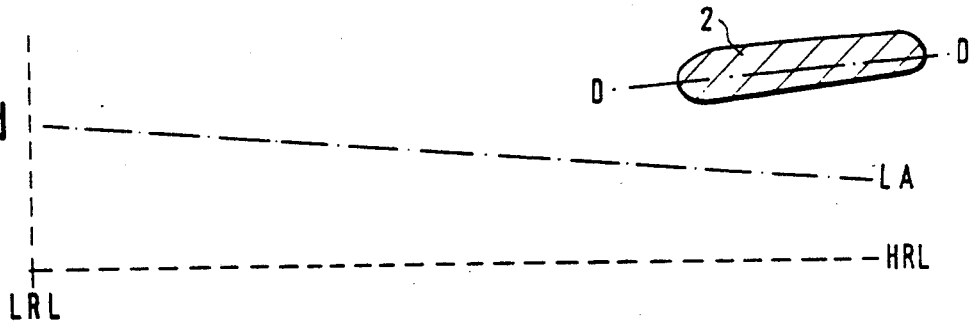

The shape of the model airplane corresponds to that of a rigid-wing aircraft with a fuselage 1 provided with sweptback wings 2 with a large sweepback and one or more fins 7 vertically stabilizing the vertical axis of the plane.

The wings 2 are profiled with angles of wing setting variable over the wing span, i.e., geometrically and aerodynamically twisted, as will be apparent from the following.

Launching the model airplane can be performed with a catapulting hook 3 of high operating security, variably fixable lengthwise at the bottom side of the fuselage and twice secured, in connection with a catapult 22 having an elastic strap 23.

Trimming weights 6 of the simplest kind, e.g nails, allow variable aerobatic figures, e.g. a looping-like ascending circle with a roll and a subsequent slow straight descent back to the launching site.

FIGS. *2a* and *2b* indicate a longitudinal axis LA through the fuselage 1. The catapulting hook 3 consists of a mandrel-like hook member 15 provided with a recess 16, for insertion into the fuselage 1. A bolt 17 is put through the recess 16 in the hook member 15 transversely to the fuselage 1, i.e., transversely to the longitudinal direction LA. This safely prevents the catapulting hook 3 from being pulled out upon catapulting the model airplane. Additionally, a securing strap 18 of high adhesion is provided which forms a further safety device against pulling out the catapulting hook 3. In order to tighten the securing strap 18 over the hook member 15 inserted in the fuselage 1, the hook 19 of the catapulting hook 3 is offset relative to the longitudinal axis of the mandrel-like hook member 15, as is seen best from FIG. *2b*.

The catapulting hook 3 can be inserted as a trimming weight at various places in the vicinity of the center of gravity along the central longitudinal plane, in order to thereby influence the diameter d of the aerobatic figures to be performed. If the catapulting hook 3 is arranged in the vicinity of the center of gravity, i.e. approximately in position 11 of FIG. 3, the model airplane will move along a comparatively small circular path. If the catapulting hook 3 is inserted more to the front end, the model airplane will follow a circular path of a larger diameter. Given an asymmetric trim with respect to the longitudinal axis of the model airplane, provided with a trimming weight 6, e.g. a nail, the model airplane can perform a narrower or wider descent. These trimming weights may be inserted for example into the fins 7. In FIG. 3, reference numerals 9 and 10 denominate further positions for inserting the catapulting hook 3, allowing a wider diameter of the figure. In contrast thereto, reference numerals 12 and 13 indicate positions that would allow a narrower diameter d of a circle or a looping.

In order to perform loopings and circles, the model airplane is launched inclined to the ground, if a horizontal axis of the circular path, i.e. a vertical plane of flight is desired. If a vertical axis of the circular path is desired, i.e. a horizontal plane of flight in which the wings are vertically inclined towards the ground, the longitudinal axis of the fuselage is held slightly upward. Besides these, other optional planes of flight can be selected, allowing a variable diameter d of the circular path of flight and different aerobatic figures, depending on the launch speed, with the airplane always returning to the launching site.

A grip surface 14 for holding the airplane upon catapulting is provided between the wings 2 at the rear end of the fuselage.

FIG. 4 illustrates different profile sections of the wings at increasing distance from the wing roots, as is apparent from FIG. 1. The line LRL is a vertical lengthwise reference line and the line HLR is a horizontal reference line, helping to exactly define the relative dimensions and angles and thereby the three-dimensional twist of the wings 2. Moreover, the longitudinal axis LA of the fuselage 1 is indicated, the relative position of which regarding the lengthwise reference line LRL and the vertical reference line HRL is constant in all FIGS. *4a* to *4d*. The connecting lines A—A, B—B, C—C and D—D are termed wing chords and connect the outermost points of the profiles in the profile sections of the wings according to FIGS. 1 and 4. As becomes apparent from FIGS. *4a* to *4d*, the angle of inclination $\alpha$ of these wing chords (the angle of wing setting) is increasingly inclined downward in the direction of flight with an increasing distance from the wings roots, starting outward at the fuselage, and relative to the longitudinal axis LA of the fuselage 1. In the embodiment of FIG. 4, the angle $\alpha$ of the wing chord A—A is approximately 4° relative to the longitudinal axis LA, that of wing chord B—B is approximately 6°, of wing chord C—C approximately 7° and of wing chord D—D approximately 9°. Besides that, the distance of the wing chords projected on the central longitudinal plane of the airplane to the longitudinal axis LA increases with the increasing distance to the fuselage 1. In this case, the angle between the longitudinal axis of the fuselage LA and the horizontal reference line HRL is approximately 5°.

As is further apparent from FIGS. *4a* to *4d*, the distance between the respective point of the profile and the vertical reference line LRL also increases from the fuselage 1, which fact is represented by the backswept shape of the wings 2.

As can be seen in FIGS. *2a* and *2b*, the vertical reference line extends in a plane through the lowermost point of the catapulting hook 3.

Figure 5:
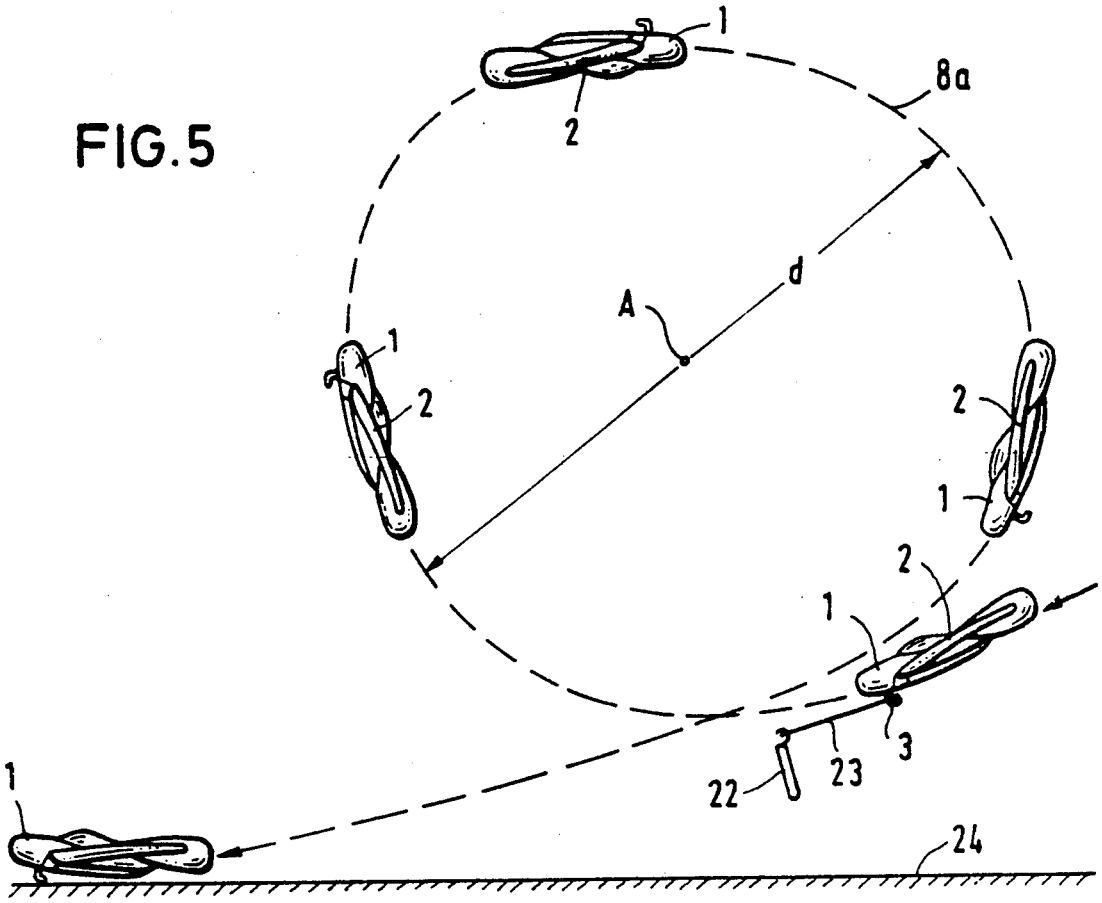
FIG. 5 is an illustration of a first aerobatic figure of the model airplane according to the present invention, launched from a horizontal position into a horizontal landing position.

FIG. 5 illustrates a looping *8a* of the model airplane with a slightly upward directed longitudinal axis LA when in the launching position, performing a substantially circular figure and a horizontal axis A, having the diameter d. As is evident from FIG. 5, the model airplane returns to the launching site and may continue a horizontal descent until it lands on the ground 24, unless it is caught before.

Figure 6:
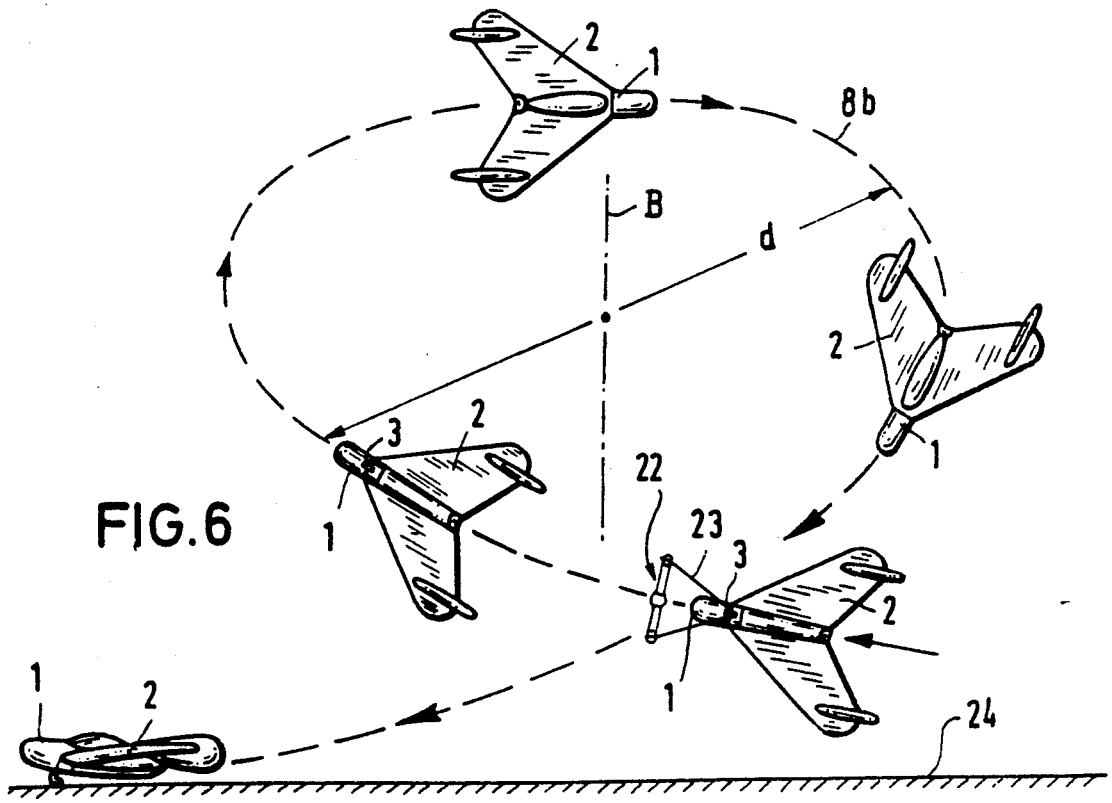
FIG. 6 is an illustration of a second aerobatic figure of the model airplane according to the present invention, launched from a position at 90° inclination with respect to the horizontal plane into a horizontal landing position.

FIG. 6 shows a circular FIG. *8b* in which the model airplane is brought into a launching position at an angle of 90° with respect to the ground, so that a circular flight path around a substantially vertical rotational axis is performed in a substantially horizontal plane of flight. In this flight, however, the model airplane can rotate around its longitudinal axis by an angle of 90° (in FIG. 6, ¼ roll to the right), so that it can also land on the ground 24 with its wings in horizontal position.

As is apparent from FIG. 1, the top surfaces of the rear ends of the wings 2 are provided with control surfaces 20 rising rearward and outward. In top view they form a triangle tapered towards the longitudinal axis of the fuselage 1. At the rear end of the wings 2, these control surfaces 20 end in a trailing edge 21 having a height in a vertical plane passing through the trailing edge 21 of approximately ⅛ to 1/25 of the wing span, i.e. the width of the wings transversely to the longitudinal axis LA.

The height of the trailing end 21 at the rear edge of the control surfaces 20 is preferably at least 1 cm. The embodiments shown in FIGS. 1 to 6 have but two wings. However, they can also be provided with combinations of a plurality of wing pairs or wings, e.g. double-deckers or triple-deckers, or one pair of wings with an additional wing, having the features described above.

In addition, rigid or movable control surfaces may be provided in canard type construction like in Canard-type-airplanes.

While the invention has been illustrated and described as embodied in a model airplane, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A model airplane comprising a fuselage having a bottom side and a longitudinal axis; a catapulting means fixed to said bottom side in vicinity of a center of gravity of said model airplane and located in a central vertical plane extending through the longitudinal axis of said fuselage; and wings, each wing having a wing root at a connection of the wings with the fuselage, a wing tip, and a sweptback profile with a large sweepback, the sweptback profile having a decreasing thickness from the wing root to the wing tip which thickness is measured in a vertical cross-sectional plane, the sweptback profile comprising a plurality of profile cross-sections extending parallel to the central vertical plane and having outermost opposite points connected by a respective plurality of imaginary lines, each imaginary line forming with the longitudinal axis of the fuselage, in a downward direction toward the bottom side of the fuselage, a respective angle of wing setting that increases, with an increase in distance of a respective profile cross-section from the wing root, from substantially 4° for a profile cross-section taken adjacent to the wing root, to substantially 9° for a profile cross-section taken adjacent to the wing tip, and each wing having a rear edge provided with a rigid control surface extending upward and rearward, said control surface being substantially triangular in shape, tapering toward said fuselage, and defining a trailing edge having a height measured in a horizontal plane passing through the trailing edge of substantially ⅛ to 1/25 of a wing span and at least 1 cm, and each wing further comprising vertical stabilizing means extending at an end of said rigid control surface remote from said fuselage, and parallel to the longitudinal axis of said fuselage.

2. A model airplane according to claim 1, wherein said airplane is made of a foamed plastic material, and said catapulting means comprises a catapulting hook.

3. The model airplane according to claim 2, wherein the catapulting hook is insertable into the bottom side of the fuselage at various points in a vertical longitudinal plane.

4. The model airplane according to claim 3, further comprising a bolt inserted into the fuselage transversely to the vertical longitudinal plane for securing the catapulting hook, said catapulting hook including a recess through which said bolt extends.

5. The model airplane according to claim 2, wherein the catapulting hook comprises a hook member, said model airplane further comprising a strip of adhesive tape disposed transversely across the hook member for securing the hook member to the fuselage.

* * * * *